US006305437B1

(12) United States Patent
Edwards et al.

(10) Patent No.: US 6,305,437 B1
(45) Date of Patent: Oct. 23, 2001

(54) ROTARY UNION ASSEMBLY FOR FILLER DEVICE AND ASSOCIATED METHOD

(75) Inventors: Simon P. Edwards, Irvine, CA (US); Michael R. Resterhouse, Muskegon; Randall L. Johnson, Grand Haven, both of MI (US)

(73) Assignees: Fogg Filler Company, Holland, MI (US); Scholle Corporation, Irvine, CA (US)

( * ) Notice: Subject to any disclaimer, the term of this patent is extended or adjusted under 35 U.S.C. 154(b) by 0 days.

(21) Appl. No.: 09/584,465

(22) Filed: May 31, 2000

(51) Int. Cl.[7] ..... B65B 57/02
(52) U.S. Cl. ..... 141/1; 141/144; 141/145
(58) Field of Search ..... 141/1, 9, 100, 141/144, 145, 59, 73

(56) References Cited

U.S. PATENT DOCUMENTS 1,778,216 * 10/1930 Hansen .
2,452,666 * 11/1948 Kuther et al. .
2,679,660 * 6/1954 Bain, Jr. .
3,166,107 * 1/1965 Swenson et al. .
3,568,734 3/1971 Vadas et al. .
3,580,298 * 5/1971 Truselle .
4,283,901 * 8/1981 Schieser et al. .
4,326,567 4/1982 Mistarz .
4,825,913 * 5/1989 Stott ..... 141/59
5,082,032 * 1/1992 Crocker ..... 141/144
5,279,339 * 1/1994 Derby ..... 141/73
5,551,491 * 9/1996 Baruffato et al. ..... 141/145
6,065,508 * 5/2000 Ball et al. ..... 141/145
6,148,876 * 11/2000 Corniani et al. ..... 141/145

FOREIGN PATENT DOCUMENTS

2215712-A * 9/1989 (GB) ..... 141/144

* cited by examiner

*Primary Examiner*—J. Casimer Jacyna
*Assistant Examiner*—Khoa D. Huynh
(74) *Attorney, Agent, or Firm*—Factor & Partners, LLC

(57) ABSTRACT

A rotary union assembly for use in a rotary filler device comprising a first product supply conduit, a second product supply conduit, and a product supply turret rotatably coupled to the first product supply conduit and the second product supply conduit, to, in turn, maintain substantially sealed coupling therebetween.

12 Claims, 3 Drawing Sheets

ROTARY UNION ASSEMBLY FOR FILLER DEVICE AND ASSOCIATED METHOD

BACKGROUND OF THE INVENTION

1. Field of the Invention

The present invention relates in general to a rotary union assembly, and more particularly, to a rotary union assembly, for use in association with a filler device, which efficiently coordinates a plurality of input supplies to a product supply turret associated therewith.

2. Background Art

Rotary union assemblies have been known in the art for years. Indeed, such assemblies are sometimes associated with rotary filling devices. While these rotary union assemblies have become commercially available, problems associated both with cleanliness and coordinating a plurality of input supplies remains largely problematic.

It is therefore an object of the present invention to provide a reliable and simple rotary union assembly which is capable of efficiently coordinating the supply of, among other things, product, electricity, a pneumatic source, a vacuum source, a cleaning material, and/or a cleaning solution to a product supply turret for use therewith, and to otherwise remedy the detriments and/or complications associated with conventional rotary union assemblies known in the art.

These and other objects of the present invention will become apparent in light of the present specification, claims, and drawings.

SUMMARY OF THE INVENTION

The present invention is directed to a rotary union assembly for use in a rotary filler device comprising: (a) a first product supply conduit; (b) a second product supply conduit; and (c) a product supply turret rotatably coupled to the first product supply conduit and the second product supply conduit, to, in turn, maintain substantially sealed coupling therebetween.

In a preferred embodiment of the invention, the product supply turret includes: (a) at least one first product disbursement conduit in fluid communication with the first product supply conduit, wherein the at least one first product disbursement conduit is capable of being placed in fluid communication with a first fill valve; and (b) at least one second product disbursement conduit in fluid communication with the second product supply conduit, wherein the at least one second product disbursement conduit is capable of being placed in fluid communication with a second fill valve.

The present invention is further directed to a method for supplying product through a rotary union assembly comprising the steps of: (a) providing a first product supply conduit; (b) providing a second product supply conduit; (c) providing a product supply turret having at least one first product disbursement conduit and at least one second product disbursement conduit; (d) associating the first product supply conduit with the at least one first product disbursement conduit; (e) associating the second product supply conduit with the at least one second product disbursement conduit; and (f) supplying a product through at least one of the first and second product supply conduits.

The present invention is also directed to a method of cleaning a rotary union assembly comprising the steps of: (a) providing a first product supply conduit; (b) providing a second product supply conduit; (c) providing a product supply turret having at least one first product disbursement conduit and at least one second product disbursement conduit; (d) associating the first product supply conduit to the at least one first product disbursement conduit; (e) associating the second product supply conduit with the at least one second product disbursement conduit; (f) associating at least one of the at least one first product disbursement conduits with at least one of the at least one second product disbursement conduits; and (g) providing a cleaning fluid through one of the first and second product supply conduits, wherein the cleaning fluid will proceed to the other of the first and second product supply conduits.

BRIEF DESCRIPTION OF THE DRAWINGS

The invention will now be described with reference to the drawings wherein.

DETAILED DESCRIPTION OF THE INVENTION

Figure 1:
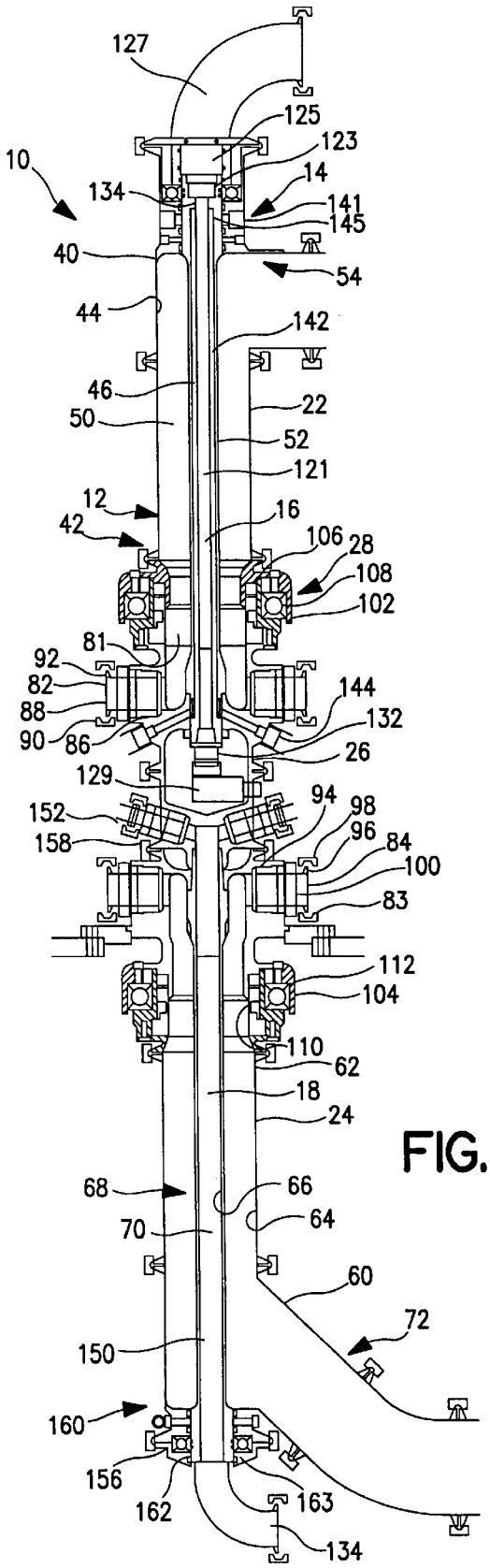
FIG. 1 of the drawings is a cross-sectional view of a rotary union assembly in accordance with the present invention.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, are identified throughout the drawings by like reference characters.

Referring now to the drawings and to FIG. 1 in particular, a cross-sectional schematic representation of a first embodiment of rotary union assembly 10 is shown, which generally comprises product supply means 12, pneumatic supply means 14, electrical supply means 16 and vacuum supply means 18.

Figure 2:
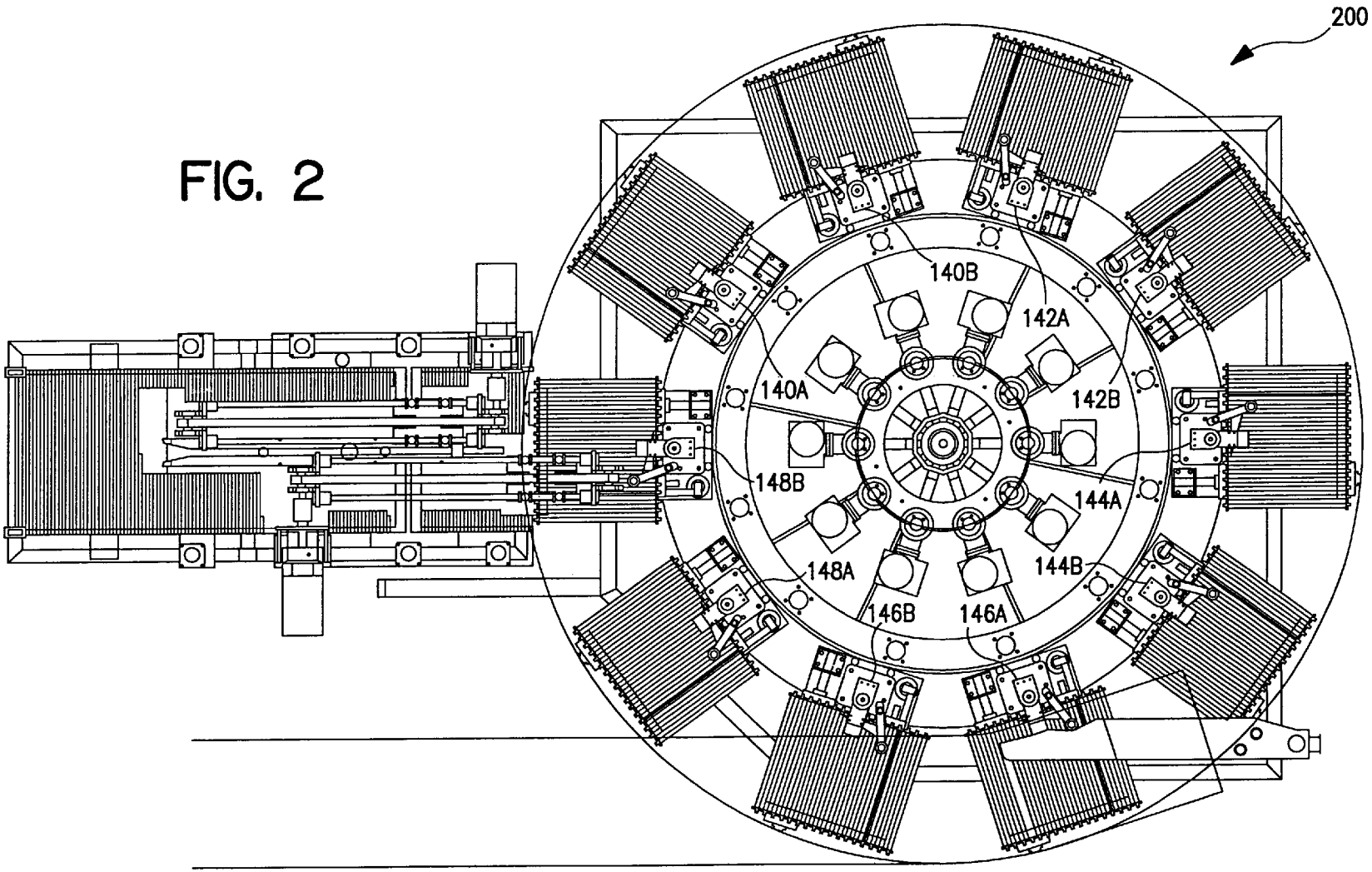
FIG. 2 of the drawings is a top plan view of a filler device associated with a rotary union assembly in accordance with the present invention.
Figure 3:
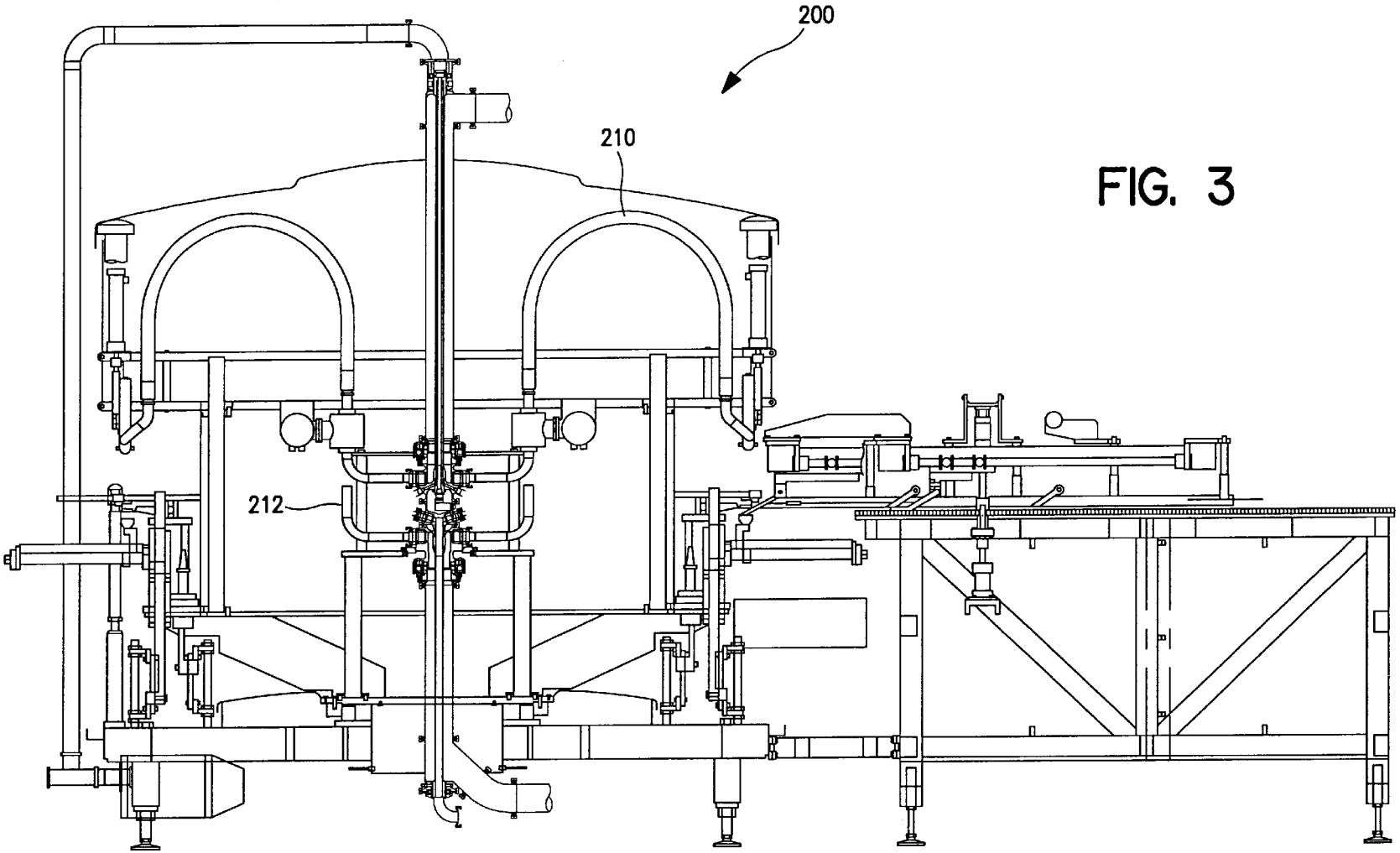
FIG. 3 of the drawings is a fragmented cross-sectional view of the filler device of FIG. 2.

As is shown in FIGS. 2 and 3, rotary union assembly 10 is primarily intended for use in association with filler device 200, which is capable of filling associated containers and/or bags with any one of a number of materials in solid, liquid, and/or gaseous states, including, for example, condiments (i.e catsup and mustard), wine, motor oil, battery acid—just to name a few.

It will be understood that the FIGS. 1–3 are merely schematic representations. As such, some of the components have been distorted from their actual scale for pictorial clarity.

Product supply means 12 is shown in FIG. 1 as including first product supply conduit 22, second product supply conduit 24, product supply turret 26 and rotatable connecting means 28. As will be explained in greater detail below, product supply means 12, essentially supplies product from storage tanks (not shown) to the individual containers.

First product supply conduit 22, as shown in FIG. 1, includes first end 40, second end 42, outer wall 44, inner wall 46. As can be seen, outer wall 44 and inner wall 46 define product flow volume 50, and inner wall 46 defines conduit volume 52. Inner wall 46 fully separates product flow volume 50 and conduit volume 52. As can be seen in FIG. 1, while a majority of the product flow volume 50 is in a vertical orientation, second end 42 of first product supply conduit 22 includes 90 degree elbow region 54 so that a portion of product flow volume 50 is in a substantially horizontal orientation. As will be understood, elbow region 54 is associated with a supply line which is in fluid communication with the product/fluid storage tank (not shown).

Each of outer wall 44 and inner wall 46 comprise a substantially circular cross-sectional shape configuration with substantially concentric longitudinal axis. In turn, the volume defined by these walls is substantially cylindrical in cross-section. Of course, other cross-sectional shapes are likewise contemplated and the invention is not limited to circular cross-sections. Additionally, it is contemplated that the longitudinal axis of each of the inner wall and the outer wall may be distally spaced from each other, however, certain advantages are realized if the longitudinal axis of each, correspond.

With respect to materials, preferably, first product supply conduit 22 comprises a stainless steel material having a sufficient thickness to support the pressure exerted by the product. Such a material is preferably resistive to corrosion and which is quite durable. Such a material is readily acceptable for use in the food industry and is approved for use by the FDA. For other applications, the material utilized may comprise any metal or alloy thereof, which may optionally include a coating. Additionally, a synthetic plastic material or a composite material may be utilized.

Second product supply conduit 24 is shown in FIG. 1 as being substantially similar to first product supply conduit 24 and includes first end 60, second end 62, outer wall 64, inner wall 66 and elbow region 72. Outer wall 64 and inner wall 66 define product flow volume 68 and inner wall 66 defines conduit volume 70. Elbow region 72 is shown at a 60 degree angle, however other angles of inclination of the elbow region are likewise contemplated. Inner wall 66 fully isolates volume 68 from volume 70.

Product supply turret 26 is shown in FIG. 1 as including first product chamber 81, at least one first product disbursement conduit 82, second product chamber 83 and at least one second product disbursement conduit 84. In the contemplated embodiment, product supply turret 26 includes five first product disbursement conduits which are substantially similar to product disbursement conduit 82, and five second product disbursement conduits which are substantially similar to product disbursement conduit 84. Each of the first product disbursement conduits are in fluid communication with first product chamber 81 and, in turn, first product supply conduit 22. Similarly, each of the second product disbursement conduits are in fluid communication with second product chamber 83 and, in turn, second product supply conduit 24.

First product disbursement conduit 82 will be described with the understanding that each of the first product disbursement conduits are substantially identical. Specifically, as shown in FIG. 1, first product disbursement conduit 82 includes first end 86, second end 88, clamp 90 and fitting 92. First end 86 is associated with first disbursement conduit 82 so as to be in fluid communication therewith. Clamp 90 and fitting 92 are positioned proximate second end 88. The clamp and the fitting are utilized to retain first product disbursement conduit 82 in fluid communication with the filling conduit 210 and one of the filling valves 140A–148A of rotary fill device 200. In the embodiment shown, wherein product supply turret 26 includes five first product disbursement conduits, the shape of the first product disbursement chamber 81 is configured so as to substantially evenly distribute and guide product (fluid) to each of the five first product disbursement conduits.

Second product disbursement conduit 84 will be described with the understanding that each of the second product disbursement conduits are substantially identical. As shown in FIG. 1, second product disbursement conduit 84 includes first end 94, second end 96, clamp 98 and fitting 100. First end 94 is associated with second product chamber 83 so as to be in fluid communication therewith. Clamp 98 and fitting 100 operate in the same fashion as clamp 90 and fitting 92 by connecting to filling conduit and to filling valves.

In the embodiment shown, the first and second product disbursement conduits are configured so that they feed alternating filling valves. Specifically, as shown in FIG. 2 of the drawings, first product disbursement conduits are associated with each of the valves identified as 140A–148A, whereas second product disbursement conduits are associated with each of the valves identified as 140B–148B. As will be explained, among other advantages, the alternating association of valves facilitates the eventual cleaning of the system.

Rotatable connecting means 28 is shown in FIG. 1 as comprising first rotatable coupling 102 and second rotatable coupling 104. First rotatable coupling 102 includes seal member 106 and bearing 108. Seal member 106 may comprise various mechanical seals, such as a mechanical ceramic based seal, as well as various rubber, carbon and plastic seals. The type of seal utilized is not critical as long as the seal is capable of providing a substantially fluid impervious seal which is capable of withstanding rotation of the turret and the supply conduit over millions of cycles. Bearing 108 comprises a conventional bearing which facilitates the controlled rotation of product supply turret 26 relative to first product supply conduit 22. Of course, other systems which facilitate low friction rotation of the turret relative to the first supply conduit 22 are contemplated for use.

Second rotatable coupling 104, as shown in FIG. 1, includes seal member 110 and bearing 112. First rotatable coupling 102 is substantially identical to second rotatable coupling 104 in structure and operation. As will be understood, the second rotatable coupling 104 facilitates the rotation of product supply turret 26 relative to second product supply conduit 24 in a substantially fluid-tight configuration.

Electricity supply means 16 is shown in FIG. 1 as comprising rotatable electric conduit 121, rotatable coupling 123, transfer case 125, external conduit 127, connecting member 129 and electrical wiring (not shown). The electricity supply means facilitates the providing of electricity to the product supply turret 26 continuously as the turret rotates relative to the first and second product supply conduits 22 and 24, respectively.

Specifically, rotatable electric conduit 121 extends through conduit volume 52 and includes proximal end 132 and distal end 134. Proximal end 132 is fixed to product supply turret 26. External conduit 127 is in communication with rotatable electric conduit 121 and positioned at the proximal end thereof. Connecting member 129 is in communication with rotatable electrical conduit 121 and positioned at the distal end thereof. Transfer case 125 and rotatable coupling 123 are associated with rotatable electric conduit 121 and positioned at proximal end 134 thereof Rotatable coupling 123 permits stable rotation of electric conduit within volume 52 relative to first product supply conduit 22 about substantially the same axis of rotation as the product supply turret 26.

As will be understood, electrical power is provided to the product supply turret 26 by wiring that extends through external conduit 127, rotating electrical conduit 121 and finally connecting member 129. Inasmuch as rotating electrical conduit 121 rotates relative to external conduit 127, transfer case 125 is supplied to facilitate and maintain electrical connectivity between the electrical wiring of the external conduit and the wiring of the rotating electrical conduit 121 and connecting member 129.

While rotating electrical conduit is shown as extending substantially the length of product supply conduit 22, it is likewise contemplated that rotating electrical conduit 121 may extend only partially through the product supply conduit, wherein the transfer case, the rotatable coupling and the external conduit extend into product supply conduit 22 toward product supply turret. Of course other embodiments are likewise contemplated which can provide electrical connectivity between the non-rotating product supply conduits 22, 24 and the rotating product supply turret 26.

Pneumatic supply means 14 is shown in FIG. 1 as comprising at least one pneumatic supply connection 141, at least one pneumatic conduit 142, at least one pneumatic connection 144 and means 145 for facilitating rotative coupling of the connection with the pneumatic conduit. Pneumatic supply connection 141 is configured so as to accept an air supply line such as an air hose (not shown). Pneumatic conduit 142 extends through at least a portion of conduit volume 52 between inner wall 46 and rotating electrical conduit 121. Pneumatic conduit joins supply connection 141 to pneumatic connection 144 in a substantially fluid tight configuration. Thus, air supplied to pneumatic supply connection 141 can be directed to the pneumatic connections. Each pneumatic connection 144 includes an end configured to readily attach to an air line that extends to one of the components on product supply turret 24, such as a filling valve.

Vacuum supply means 18 is shown in FIG. 1 as comprising rotating vacuum conduit 150, at least one connecting coupling 152, external connecting coupling 154 and rotation facilitating means 156. Rotating vacuum conduit 150 includes proximal end 158 and distal end 160. Proximal end 158 is associated with product supply turret 26. Each of the at least one connecting coupling 152 is in fluid communication with rotating vacuum conduit 150. As will be understood, connecting coupling 152 is then attached to a container, a bag or the like to facilitate the removal of any air or other materials (i.e. fluids) that may be in the bag.

External connecting coupling 154 is in fluid communication with distal end 160 of rotating vacuum conduit 150. Inasmuch as the rotating vacuum conduit 150 rotates relative to external connecting coupling 154, seals, such as seal 162 are provided to minimize leaking of this connection. Rotation facilitating means 156 comprises bearing 163 that is positioned so as to permit low-friction rotation of rotating vacuum conduit 150 relative to second product supply conduit 24.

Prior to operation, rotary union assembly 10 is assembled and positioned in a rotary filler device, such as rotary filler device 200 (FIGS. 2 and 3). Once positioned, fill valves 140A–148A are coupled to first product disbursement conduits 82 and fill valves 140B–148B are coupled to second product disbursement conduits 84. Specifically, as shown in FIG. 2, every other fill valve is associated with the same product supply conduit so that half of the fill valves are filled with product from first product supply conduit 22 and half of the fill valves are filled with product from the second product supply conduit 24.

To couple a selected fill valve to first product disbursement conduit 82, a conduit, such as conduit 210 (FIG. 3) is connected to the respective fill valve at one end and, as shown in FIG. 1, to second end 88 of first product disbursement conduit 82 by way of fitting 92 and clamp 90. In a similar manner, to couple a selected fill valve to second product disbursement conduit 84, a conduit, such as conduit 212 (FIG. 3) is connected to the desired fill valve at one end and, as is shown in FIG. 1, to second end 96 of second product disbursement conduit 84 by way of fitting 100 and clamp 98.

Next, devices, which are pneumatically powered (i.e. by compressed air), are associated with pneumatic supply means 14. Specifically, pneumatic supply connection 141 is associated with an outside pneumatic source, such as a compressor, which is capable of providing the desired pneumatic supply at a desired rate. In an embodiment wherein the fill valves are controlled pneumatically, pneumatic lines (not shown) are associated with the fill valve and connected to pneumatic connection 144 (FIG. 1). Once these connections are established, the fill valve is in fluid communication with the pneumatic source via pneumatic supply connection 141, pneumatic conduit 142 and pneumatic connection 144. Of course, the specific number of connections, such as pneumatic connection 144, can be varied depending on the particular requirements for any given embodiment.

Subsequently, any electrically driven components associated with product supply turret 26 can be wired to the wiring that extends through rotating electrical conduit 121 and connecting member 129. As explained above, by way of transfer case 125, electrical connectivity between the wiring in rotating electrical conduit 121 and external conduit 127 is maintained during rotation of the product supply turret 26.

As shown in FIG. 1, should any component which rotates with product supply turret 26 require a vacuum connection, such a component is placed in fluid communication with connecting coupling 152 of vacuum supply means 18. Connecting coupling 152, as explained above, may comprise any one of a number of different coupling connections such as a snap connection, a threaded connection and the like.

Once all of the connections for each of the product supply means 12, pneumatic supply means 14, electricity supply means 16 and vacuum supply means 18 are established and their supply is activated, rotary union assembly 10 is ready for operation.

Specifically, in operation, as shown in FIGS. 1 and 2, product supply turret 26 begins to rotate relative to first product supply conduit 22 and second product supply conduit 24. Yet, by way of rotatable connecting means 28 and 104, seals are maintained at interfaces of product supply turret 26 and each of the product supply conduits 22, 24.

As shown in FIG. 1, rotating electrical conduit 121 is attached to product supply turret 26 at its proximal 132, and rotates with product turret 26. Rotatable coupling 123 maintains steady low friction rotation of the rotating electrical conduit relative to first product supply conduit 22, and, transfer case 125 maintains electrical connectivity of the rotating wiring relative to the stationary wiring.

As shown in FIG. 1, pneumatic connections, such as pneumatic connection 144 is coupled to product supply turret 26, and in turn, pneumatic conduit 142 and rotates therewith. Rotative coupling means 145 maintains fluid communication between pneumatic supply conduit 142 and pneumatic supply connections 141 and to insure an uninterrupted supply of pneumatic power during rotation and operation of product supply turret 26.

Likewise, as shown in FIG. 1, proximal end 158 of rotating vacuum conduit 150 is attached to product supply turret 26 and rotates therewith. Distal end 160 is maintained in a steady, low-friction rotation relative to second product supply conduit 24 by way of rotation facilitating means 156.

As product supply turret 26 rotates and operation of the fill valve apparatus proceeds, supply turret 26 supplies product to each of the fill valves from product supply means 12. Specifically, product passes through first product supply conduit 22 from first end 40 to second end 42. Subsequently, the product is directed beyond seal member 106 of first coupling 102 into first product chamber 81 which is rotating with product supply turret 26. At such time, the product is distributed to each of the first product disbursement conduits 82, to the respective fill valves and, in turn, to the respective container associated therewith.

As can be appreciated, at any one time, certain of the fill valves will be in the open position (i.e. container filling position) and certain of the fill valves will be in the closed position (i.e. container filled or no container attached). Thus, the rate of flow from first product chamber 81 to each of the first product disbursement conduits 82 will be varied and the flow rate is controlled by the fill valve.

Product is also directed to second product supply conduit 24 from first end 60 to second end 62. At that time, the product is directed beyond the seal member of second coupling 104 into second product chamber 83 which is rotating. In turn, the product is directed from second product chamber 83 to the respective second product disbursement conduits 84. As explained above, since certain fill valves will be open and others will be closed, the supply to each second product disbursement conduit at any given time varies and is generally controlled by the fill valve.

During the filling operations and the rotation of product supply turret 26, electrical supply is provided as needed by electricity supply means 16, pneumatic power as needed is supplied by pneumatic supply means 14, vacuum supply as needed is supplied by vacuum supply means 18. None of these means are disrupted by the rotation of the product supply turret 26.

From time to time it becomes necessary to clean product supply means 12. One manner in which to clean the product supply means comprises the feeding of a cleaning (or CIP) solution through the product supply means. In particular, any containers attached to fill valves are removed. Next, each fill valve associated with first product supply conduit 22 is coupled to a fill valve associated with second product supply conduit 24. As explained above, wherein supply to the fill valves is alternated, proper coupling of the fill valves only requires the coupling of a fill valve to an immediately adjacent fill valve.

Once each fill valve is coupled to another fill valve, a cleaning solution is supplied to first product supply conduit 22. The cleaning solution travels through first product supply conduit 22 from first end 40 to second end 42 and then enters first product chamber 81 wherein it is distributed to each of the first product disbursement conduits 82. The first product disbursement conduits distribute the cleaning solution to every other fill valve (i.e. 140A–148A). Inasmuch as each fill valve 140A–148A is coupled to one of fill valves 140B–148B, the cleaning solution is directed through each of the fill valves 140B–148B back to second product disbursement conduit 84. At such time the solution proceeds through second product chamber 83 and eventually through second product supply conduit 24 from second end 62 to first end 60 where it can be collected for filtering and reuse, or for disposal.

The cleaning solution can likewise be reversed so that the solution is introduced through second product supply conduit 24 and collected at first product supply conduit 22 for filtering and reuse or for disposal.

Once the cleaning of the product supply conduit is completed, fill valves 140A–148A are disconnected from respective fill valves 140B–148B and the system is again ready for operation. Advantageously, by alternating fill valves 140A–148A with fill valves 140B–148B, and by providing two product supply conduits, in the embodiment shown, only five short hoses (or conduits) are required to connect the respective fill valves to prepare the system for cleaning.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A rotary union assembly for use in a rotary filler device, comprising:

a first product supply conduit having a first product inlet;

a second product supply conduit having a second product inlet; and a product supply turret having a first product chamber and a second product supply turret having a first product chamber and a second product chamber, the product supply turret rotatably coupled to the first product supply conduit and the second product supply conduit, to, in turn, maintain substantially sealed coupling therebetween, wherein the product supply turret is positioned such that the first product supply conduit is positioned above the product supply turret and capable of feeding product from the first product inlet to the first product chamber in a downward direction, and the second product supply conduit is positioned below the product supply turret and capable of feeding product from the second product inlet to the second product chamber in an upward direction.

2. The rotary union assembly according to claim 1, wherein the product supply turret includes:

at least one first product disbursement conduit in fluid communication with the first product supply conduit, wherein the at least one first product disbursement conduit is capable of being placed in fluid communication with a first fill valve; and at least one second product disbursement conduit in fluid communication with the second product supply conduit, wherein the at least one second product disbursement conduit is capable of being placed in fluid communication with a second fill valve.

3. The rotary union assembly according to claim 2, wherein:

the at least one first product disbursement conduit comprises at least two first product disbursement conduits, each associated with a distinct first fill valve;

the at least one second product disbursement conduit comprises at least two second product disbursement conduits, each associated with a distinct second fill valve;

wherein the first and second fill valves are arranged so as to alternate between first fill valves and second fill valves about the rotary union assembly.

4. The rotary union assembly according to claim 3, wherein:

the at least one first product disbursement conduit comprises five first product disbursement conduits, each associated with a distinct first fill valve; and wherein the at least one second product disbursement conduit comprises five second product disbursement conduits, each associated with a distinct second fill valve.

5. The rotary union assembly according to claim 1, further comprising means for supplying electricity to the product supply turret.

6. The rotary union assembly according to claim 5, wherein the electricity supply means comprises:

a rotatable electrical conduit associated with the product supply turret, wherein the conduit includes at least one wire;

an external conduit including at least one wire; and a transfer case, to, in turn, maintain electrical connectivity between the at least one wire of the rotatable electrical conduit and the at least one wire of the external conduit during rotation of the product supply turret, and rotatable electrical conduit, relative to the external conduit.

7. The rotary union assembly according to claim 6, wherein one of the first and second product supply conduits includes an inner wall extending there through, the inner wall defining a conduit volume, at least a portion of the rotatable electrical conduit extending through the conduit volume.

8. The rotary union assembly according to claim 1 further comprising a vacuum supply means.

9. The rotary union assembly according to claim 8, wherein the vacuum supply means comprises:

a rotatable vacuum conduit associated with the product supply turret;

a connecting coupling coupled to the rotating vacuum conduit;

an external connecting coupling associated with the rotating vacuum conduit and capable of coupling to a vacuum source; and means for facilitating rotation of the rotating vacuum conduit relative to one of the product supply conduits while maintaining vacuum in the rotating vacuum conduit.

10. The rotary union assembly according to claim 9, wherein one of the first and second product supply conduits includes an inner wall extending there through, the inner wall defining a conduit volume, at least a portion of the rotating vacuum conduit extending through the conduit volume.

11. The rotary union assembly according to claim 1, further comprising pneumatic supply means.

12. The rotary union assembly according to claim 11, wherein the pneumatic supply means comprises:

a pneumatic supply connection;

a pneumatic conduit associated with the pneumatic supply connection;

at least one pneumatic connection; and means for rotatably coupling the pneumatic connection to the pneumatic conduit in a substantially fluid tight coupling.

* * * * *